US009945335B2

(12) United States Patent
Jackson

(10) Patent No.: US 9,945,335 B2
(45) Date of Patent: Apr. 17, 2018

(54) MOTOR VEHICLE HYDROCARBON TRAP AND METHOD

(75) Inventor: Graham Jackson, Warwickshire (GB)

(73) Assignee: JAGUAR LAND ROVER LIMITED, Whitley, Coventry (GB)

( * ) Notice: Subject to any disclaimer, the term of this patent is extended or adjusted under 35 U.S.C. 154(b) by 1192 days.

(21) Appl. No.: 14/116,144

(22) PCT Filed: May 10, 2012

(86) PCT No.: PCT/EP2012/058699

§ 371 (c)(1),
(2), (4) Date: Jan. 31, 2014

(87) PCT Pub. No.: WO2012/152894

PCT Pub. Date: Nov. 15, 2012

(65) Prior Publication Data

US 2014/0209051 A1 Jul. 31, 2014

(30) Foreign Application Priority Data

May 12, 2011 (GB) ..... 1107919.1

(51) Int. Cl.
*F02M 35/10* (2006.01)
*F02M 35/12* (2006.01)
(Continued)

(52) U.S. Cl.
CPC ..... *F02M 35/12* (2013.01); *F02M 35/0218* (2013.01); *F02M 35/1216* (2013.01); *F02M 25/08* (2013.01); *Y10T 29/49229* (2015.01)

(58) Field of Classification Search
CPC ..... F02M 35/12; F02M 35/1216; F02M 35/0218; F02M 25/08; F02M 35/1272; Y10T 29/49229
(Continued)

(56) References Cited

U.S. PATENT DOCUMENTS 8,205,442 B2 * 6/2012 Dobert ..... B01D 53/0431 123/519
2002/0029693 A1 3/2002 Sakakibara et al.
(Continued)

FOREIGN PATENT DOCUMENTS

CN 201661389 U 12/2010
DE 112007002530 T5 9/2009
(Continued)

OTHER PUBLICATIONS

Combined Search and Examination Report under Sections 17 and 18(3) for Application No. GB1107919.1 dated Sep. 12, 2012.
(Continued)

*Primary Examiner* — Hung Q Nguyen
(74) *Attorney, Agent, or Firm* — Carlson, Gaskey & Olds

(57) ABSTRACT

Embodiments of the invention provide an apparatus for damping or attenuating acoustic vibrations in an air induction system of a motor vehicle, the apparatus defining a passageway through which induction air may be drawn to an engine of the vehicle, the apparatus comprising: damping means, the damping means being provided around the passageway for damping or attenuating acoustic vibrations in the induction air; and hydrocarbon trapping means, the hydrocarbon trapping means comprising a sheet of trapping material provided around at least a portion of the passageway, the trapping means being arranged to provide a flow-past hydrocarbon trap for trapping hydrocarbon vapors entering the passageway from the engine.

18 Claims, 3 Drawing Sheets

(51) Int. Cl.
*F02M 35/02* (2006.01)
*F02M 25/08* (2006.01)

(58) Field of Classification Search
USPC ..... 181/222, 214, 252, 284, 290–294
See application file for complete search history.

(56) References Cited

U.S. PATENT DOCUMENTS

| | | | |
|---|---|---|---|
| 2005/0284692 | A1 | 12/2005 | McWilliam et al. |
| 2007/0278034 | A1 | 12/2007 | Yamaura et al. |
| 2008/0127949 | A1 | 6/2008 | Herald et al. |
| 2010/0089372 | A1 | 4/2010 | Bellis et al. |
| 2011/0011670 | A1 | 1/2011 | Ishida et al. |

FOREIGN PATENT DOCUMENTS

| | | | |
|---|---|---|---|
| EP | 2249020 | A1 | 11/2010 |
| JP | H02020776 | U | 2/1990 |
| JP | 2002004956 | A | 1/2002 |
| JP | 2003035225 | A | 2/2003 |
| JP | 2006090252 | A | 4/2006 |
| WO | 02/084099 | A1 | 10/2002 |
| WO | 2009110344 | A1 | 9/2009 |

OTHER PUBLICATIONS

Combined Search and Examination Report under Sections 17 and 18(3) for Application No. GB1208234.3 dated Aug. 7, 2012.
International Search Report for International application No. PCT/EP2012/058699 dated Oct. 18, 2012.

* cited by examiner

MOTOR VEHICLE HYDROCARBON TRAP AND METHOD

CROSS REFERENCE TO RELATED APPLICATION

This application claims priority from UK Patent Application No. GB1107919.1 filed 12 May 2011, the entire contents of which are expressly incorporated by reference herein.

TECHNICAL FIELD

The present invention relates to hydrocarbon traps and to a method of trapping hydrocarbons emitted by a motor vehicle. Aspects of the invention relate to a damper, to an apparatus, to a system, to a vehicle and to a method.

BACKGROUND

Evaporative emissions of hydrocarbons from motor vehicles when parked are a known environmental issue. Evaporative emissions may be caused when small quantities of fuel vapour flow from the engine in a reverse direction along air induction conduits of the vehicle and out from an air intake of the vehicle.

One way of reducing or preventing evaporative emissions is to provide a hydrocarbon trap in the air intake of the vehicle. It is known to provide a flow-through trap in the form of a membrane of a hydrocarbon-trapping medium such as a sheet of activated carbon in an air filter compartment of a vehicle. Flow-through traps have the disadvantage that a back pressure is developed on air being drawn through the trap.

It is an aim of the invention to address this problem. Other aims and advantages of the invention will become apparent from the following description, claims and drawings.

SUMMARY

Embodiments of the invention provide an apparatus, an air induction system, a motor vehicle and a method. Embodiments of the invention may be understood by reference to the appended claims.

In one aspect of the invention for which protection is sought there is provided an apparatus for damping or attenuating acoustic vibrations in an air induction system of a motor vehicle, the apparatus defining a passageway through which induction air may be drawn to an engine of the vehicle, the apparatus comprising: damping means, the damping means being provided around the passageway for damping or attenuating acoustic vibrations in the induction air; and hydrocarbon trapping means, the hydrocarbon trapping means comprising a sheet of trapping material provided around at least a portion of the passageway, the trapping means being arranged to provide a flow-past hydrocarbon trap for trapping hydrocarbon vapours entering the passageway from the engine.

Embodiments of the invention have the feature that a hydrocarbon trap may be incorporated into an existing component of the air induction apparatus. Furthermore, embodiments of the invention have the advantage that a backpressure on air flowing through the damper may be substantially unaffected since the trap is a flow-past trap rather than a flow-through trap or filter.

Furthermore, by providing the hydrocarbon trapping means in the form of a sheet of trapping material manufacture of the apparatus may be made relatively straightforward. It is to be understood that persons assembling the apparatus are not required to handle loose hydrocarbon trapping material such as powder, fibres of the like.

The sheet of trapping material may be arranged to wrap around the passageway.

The apparatus may comprise a former arranged to define the passageway through the apparatus.

The former may be provided with a plurality of apertures therein for flow of vapour therethrough.

The sheet of trapping material may be arranged to wrap around the former.

The sheet of trapping material may be disposed between the passageway and the damping means.

The apparatus may comprise a filter membrane provided between the passageway and the hydrocarbon trapping means.

This feature prevents particles of material that may become separated from the trapping medium or pulsation damper absorber pack from entering the passageway and becoming entrained in air flow through the passageway.

The filter membrane in some embodiments comprises a mesh or gauze.

The filter membrane may be provided between the former and the hydrocarbon trapping means.

The apparatus may comprise a housing arranged to define a pulsation damper cavity in which the hydrocarbon trapping means and damping means are provided.

The housing and former may be substantially cylindrical in shape, the former and housing being substantially coaxial.

The hydrocarbon trapping means may be arranged to electrostatically bond thereto fuel vapours entering the passageway.

The hydrocarbon trapping means is arranged to release trapped hydrocarbons to airflow through the passageway when induction air is drawn through the apparatus during normal engine operation.

In a further aspect of the invention there is provided an air induction system for a motor vehicle having a pulsation damper comprising an apparatus according to the preceding aspect.

In a still further aspect of the invention there is provided a motor vehicle comprising an air induction system according to the preceding aspect.

In a further aspect of the invention for which protection is sought there is provided a method of trapping hydrocarbon vapour in a motor vehicle air induction system, comprising: providing apparatus for damping or attenuating acoustic vibrations in the air induction system; when an engine of the vehicle is switched off, passing hydrocarbon vapours from the engine of the vehicle through a passageway of the apparatus and trapping the vapours by means of a flow-past hydrocarbon trap comprising hydrocarbon trapping means in the form of a sheet of trapping material provided around at least a portion of the passageway, when the engine of the vehicle is switched on the method comprising drawing induction air through the apparatus and damping or attenuating acoustic vibrations in the induction air by means of damping means of the apparatus.

The method comprises the step of providing a former within the damper to define a passageway for induction air through the damper and wrapping the hydrocarbon trap around the former.

The method may comprise providing the hydrocarbon trap in the form of a sheet.

In a still further aspect of the invention for which protection is sought there is provided an apparatus for an air induction system of a motor vehicle, the apparatus comprising: a passageway through which induction air may be drawn through the apparatus; a pulsation damper absorber pack provided around the passageway; and a hydrocarbon trapping medium between the passageway and the absorber pack, the trapping medium being arranged to trap hydrocarbon vapours entering the passageway from the engine.

Embodiments of the invention have the feature that a hydrocarbon trap may be incorporated into an existing component of the air induction apparatus. Furthermore, embodiments of the invention have the advantage that a backpressure on air flowing through the damper may be substantially unaffected.

The damper comprises a filter membrane provided between the passageway and the trapping medium.

The filter membrane optionally comprises a mesh or gauze.

The filter membrane may comprise a woven material, a non-woven material or any other suitable material.

The damper may comprise a former arranged to define the passageway through the damper.

The former may be of a substantially cylindrical shape or any other suitable shape.

The former may comprise a material defining a plurality of apertures for flow of vapour therethrough.

The trapping medium is arranged to wrap around the former and to be supported thereby.

Optionally the filter membrane is provided between the former and the trapping medium.

The damper comprises a housing arranged to define a pulsation damper cavity in which the former, trapping medium and absorber pack are provided.

Optionally the housing and former are substantially cylindrical in shape, the former and housing being substantially coaxial.

Further optionally the trapping medium is arranged electrostatically to bond thereto fuel vapours entering the passageway.

The trapping medium is arranged to release trapped hydrocarbons to airflow through the passageway when induction air is drawn through the damper during normal engine operation.

In a further aspect of the invention there is provided a motor vehicle air induction apparatus comprising a pulsation damper according to the previous aspect.

In a still further aspect of the invention there is provided a motor vehicle comprising air induction apparatus according to the preceding aspect.

In another aspect of the invention there is provided a method of trapping hydrocarbon vapour in a motor vehicle air induction apparatus comprising: providing a pulsation damper in a portion of the air induction apparatus; trapping by means of a flow-past hydrocarbon trap hydrocarbons passing the pulsation damper portion at a location between a passageway through the damper and a damper absorber pack of the damper.

The method may comprise the step of providing a former within the damper to define a passageway for induction air through the damper and providing the hydrocarbon trap around the former.

Various features of embodiments of the invention are mentioned in the following description and in the appended claims.

Within the scope of this application it is envisaged that the various aspects, embodiments, examples and alternatives, and in particular the individual features thereof, set out in the preceding paragraphs, in the claims and/or in the following description and drawings may be taken independently or in any combination. For example, features described in connection with one embodiment are applicable to all embodiments unless such features are incompatible.

BRIEF DESCRIPTION OF THE DRAWINGS

Embodiments of the invention will now be described, by way of example only, with reference to the accompanying figures in which.

DETAILED DESCRIPTION

Figure 1:
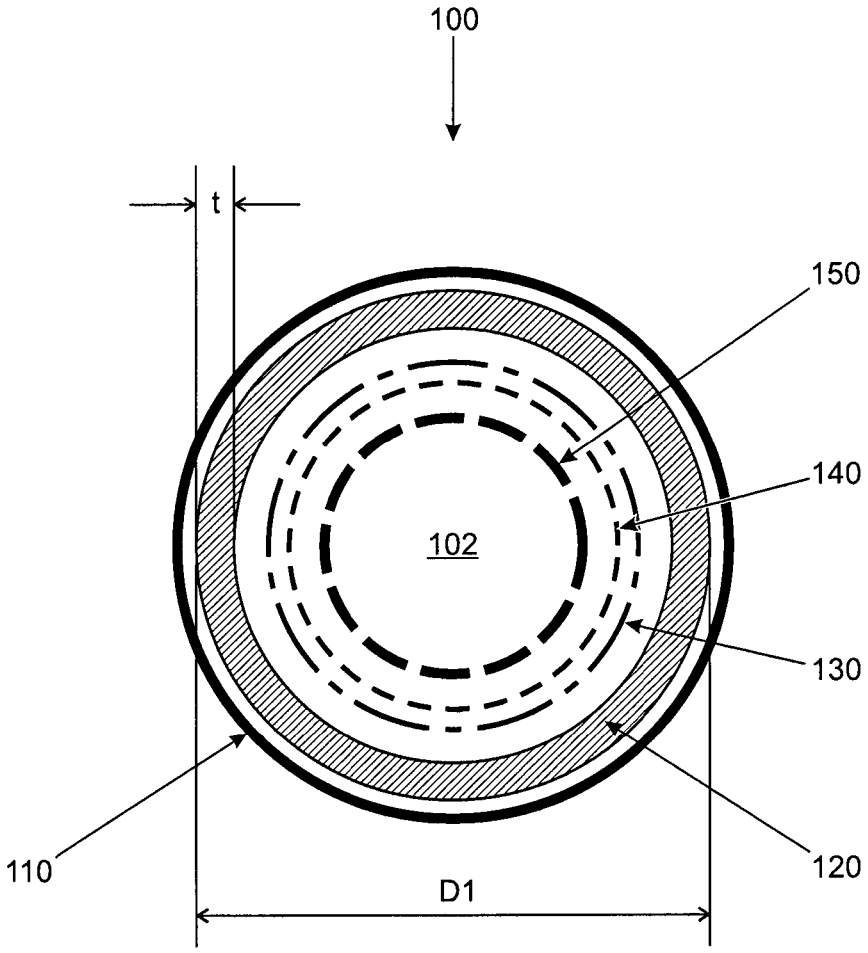
FIG. 1 is a schematic cross-sectional view of a damper according to an embodiment of the present invention.

FIG. 1 shows a structure of a pulsation damper 100 according to an embodiment of the present invention. The damper 100 has an outer housing 110 in the form of a hollow tube that is arranged to be coupled at each end to a respective end connector 112, 113 of the damper 100 (FIG. 3).

Figure 2:
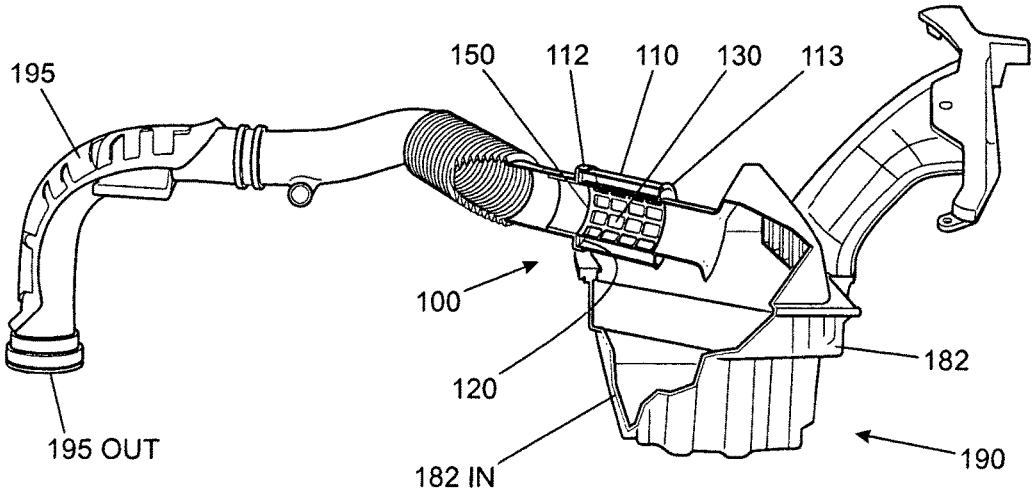
FIG. 2 is a perspective view of a frame of the damper of FIG. 1.

FIG. 2 shows the damper 100 installed in a motor vehicle air induction system or apparatus 190. The end connectors 112, 113 allow connection of the damper 100 to portions of the air induction apparatus 190 upstream and downstream of the damper 100.

In the damper 100 shown, the housing 110 has an internal diameter D1 of around 90 mm and a wall thickness of around 2.5 mm. It is to be understood that other sizes are also useful, depending on the engine air flow requirement and available package space.

Figure 3:
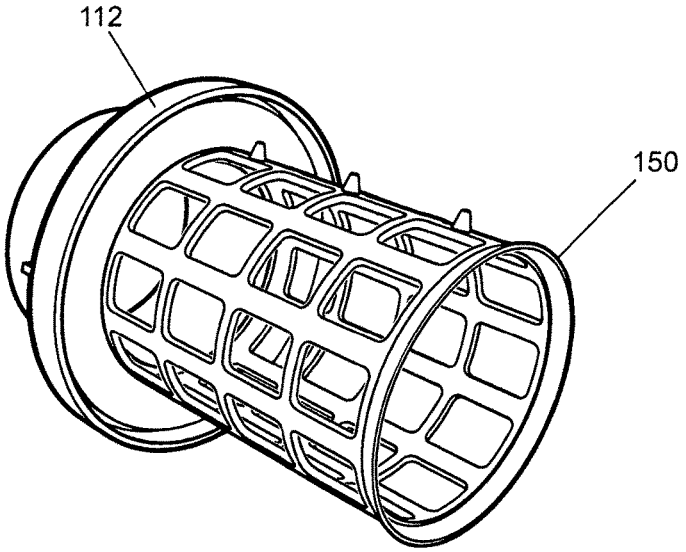
FIG. 3 shows the damper of FIG. 1 and FIG. 2 installed in an air induction apparatus of a motor vehicle.

A passageway 102 is defined through the damper 100 by a porous cylindrical cage 150 coaxial with the housing 110 as shown in FIG. 3. The cage 150 has a diameter of around 65 mm in the embodiment shown. In the embodiment shown, the cage 150 is in the form of a nylon grid structure, apertures of the grid being rectangular in shape and of size around 18 mm by 35 mm. Other sizes and shapes of aperture are also useful.

A layer of a gauze 140 (in the embodiment shown the gauze 140 is a nylon gauze) is provided around an outer surface of the cage 150. Other materials are also useful for the gauze 140 including steel, stainless steel and other materials.

The gauze 140 is arranged to provide a vapour permeable barrier between the passageway 102 and a sheet 130 of a hydrocarbon trapping medium. In the embodiment shown the sheet 130 is in the form of a gas-permeable substrate impregnated with activated carbon particles. In some embodiments the substrate may be coated with activated carbon. In some arrangements two or more sheets are employed.

In the embodiment shown the substrate is formed from synthetic polymer fibre with a nitrile polymer binder. In some arrangements the substrate is in the form of a woven polyester material although other woven or non-woven materials are also useful.

In the embodiment shown the sheet 130 is around 1 mm in thickness and is wrapped around the gauze 140. Other arrangements are also useful.

In some embodiments the sheet 130 has apertures formed therein. The purpose of the apertures is to reduce a risk that the sheet 130 compromises significantly an attenuation efficiency of the damper 100, whilst still allowing surface area for hydrocarbon trapment.

Figure 4:
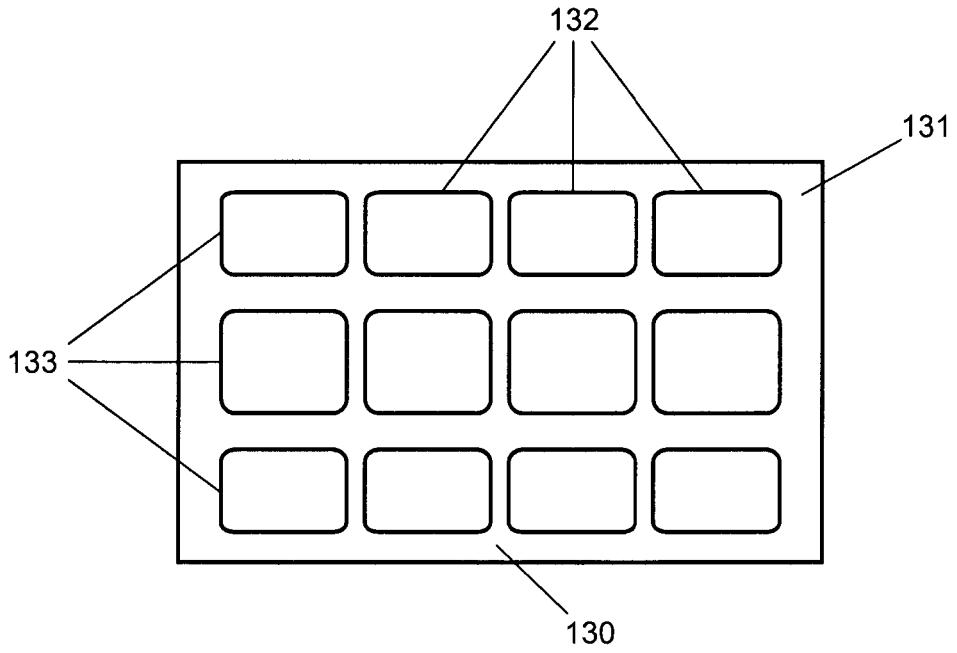
FIG. 4 shows a sheet of hydrocarbon trapping material for use in the damper of FIG. 1 and FIG. 2.

FIG. 4 is a schematic illustration of a sheet 130 of trapping medium for use with a pulsation damper 100 according to an embodiment of the invention. The sheet 130 has an array of apertures 132 therein each around 18 mm×35 mm in size although other sizes of aperture are also useful. At one end of the sheet 130 a row of smaller apertures 133 are provided across a width of the sheet 130. The apertures 133 are arranged to allow the sheet 130 to be conveniently coupled to corresponding pin elements 150P of the cage 150. In the embodiment shown three apertures 133 are provided in the sheet 130 the cage 150 is provided with three corresponding pin elements 150P.

A pulsation absorber pack 120 in the form of a layer of material arranged to absorb, attenuate or dampen acoustic vibrations of a prescribed range of frequencies is provided around the sheet 130. The thickness, density and structure of the material forming the absorber pack 120 is optimised for absorption of the particular range of frequencies of interest. In the embodiment shown the thickness t of the pack 120 is around 10 mm, the pack 120 being provided in abutment with the inner surface of the housing 110. It is to be understood that other thicknesses are also useful. In some arrangements the layer is provided in the form of a cylindrical tube.

In use, when the vehicle is parked with the engine off, it is possible that a small amount of unburned fuel remaining in the induction system of the engine may vaporise and escape the engine via the air induction apparatus 190, the fuel being released in the form of trace amounts of vapour. With the regulations regarding vehicle emissions becoming increasingly strict, such escape of the vapour is undesirable.

Embodiments of the invention overcome this problem by providing a damper having a hydrocarbon trapping medium for trapping the hydrocarbon vapour that travels along the air induction apparatus 190. In the embodiment shown, the pulsation damper 100 is provided between an induction air conduit 195 and an induction air filter 182 of the apparatus 190 and the vapours must pass through the damper 100 before reaching the induction air filter 182. The damper 100 is arranged such that vapours passing through the passageway 102 in the damper 100 are attracted electrostatically by Van der Waals forces to the sheet 130 and thereby become absorbed by (or adsorbed to) the sheet 130.

When the engine of the vehicle is restarted, the flow of induction air through the damper 100 causes hydrocarbons trapped by the sheet 130 to be released and drawn into the engine thereby to be combusted. In some arrangements the hydrocarbon molecules are weakly bonded electrostatically to the sheet 130, the flow of induction air causing the bonds between the molecules and sheet 130 to be broken.

Embodiments of the invention have the advantage that a flow-past hydrocarbon trap may be conveniently provided in an existing component of a motor vehicle air induction apparatus 190 (i.e. in a pulsation damper 100) without a requirement to provide a separately packaged hydrocarbon trapping medium. Rather, the trapping medium is incorporated around a radially inner portion of an existing pulsation damper 100 in the form of a sheet 130 of trapping medium and does not reduce a diameter of an air passageway 102 through the damper 100. Because the sheet 130 provides a flow-past filter (rather than a flow-through filter) a back-pressure on induction air flowing through the apparatus 190 is substantially unaffected by the presence of the trapping medium.

Some embodiments of the invention have the advantage that incorporation of the hydrocarbon trapping medium in the induction air system does not reduce significantly a vehicle assembly time. In some embodiments incorporation of the hydrocarbon trapping medium does not cause substantially any package space reductions within the engine bay since the trapping medium is incorporated into an existing component. Furthermore, assembly of the system does not require handling of loose material such as powder, fibre or other loose material. Rather, assembly requires only wrapping of a sheet around a former in some embodiments.

In some embodiments such as that described above incorporation of the trapping medium may be made as a rolling change or upgrade, for example at a vehicle service interval.

In some arrangements an extent to which acoustic pulses are attenuated by the pulsation damper 100 is found to be enhanced in the presence of the sheet 130.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. An apparatus for damping or attenuating acoustic vibrations in an air induction system of a motor vehicle, the apparatus defining a passageway through which induction air may be drawn to an engine of the vehicle, the apparatus comprising:

a damper provided around the passageway for damping or attenuating acoustic vibrations in the induction air, wherein the damper comprises a pulsation absorber pack configured to damp or attenuate acoustic vibrations in the induction air;

a hydrocarbon trap comprising a sheet of trapping material provided around at least a portion of the passageway, the hydrocarbon trap being arranged to provide a flow-past hydrocarbon trap for trapping hydrocarbon vapors entering the passageway from the engine; and a housing arranged to define a pulsation damper cavity in which the hydrocarbon trap and damper are provided, wherein the housing has an inner surface, and wherein the pulsation absorber pack is disposed between the inner surface of the housing and the passageway.

2. An apparatus as claimed in claim 1 wherein the sheet of trapping material is arranged to wrap around the passageway.

3. An apparatus as claimed in claim 1 comprising a former arranged to define the passageway through the apparatus.

4. An apparatus as claimed in claim 3 wherein the former is provided with a plurality of apertures configured to accommodate a flow of vapor through the apertures.

5. An apparatus as claimed in claim 3 wherein the sheet of trapping material is arranged to wrap around the former.

6. Apparatus as claimed in claim 1 wherein the sheet of trapping material is disposed between the passageway and the damper.

7. An apparatus as claimed claim 1 comprising a filter membrane provided between the passageway and the hydrocarbon trap.

8. An apparatus as claimed in claim 7 wherein the filter membrane comprises a mesh or gauze.

9. An apparatus as claimed in claim 7 and comprising a former arranged to define the passageway through the apparatus, wherein the filter membrane is provided between the former and the hydrocarbon trap.

10. An apparatus as claimed in claim 1 comprising a former arranged to define the passageway through the apparatus wherein the housing and the former are substantially cylindrical in shape, the former and the housing being substantially coaxial.

11. An apparatus as claimed in claim 1 wherein the hydrocarbon trap is arranged to electrostatically bond with fuel vapors entering the passageway.

12. An apparatus as claimed in claim 1 wherein the hydrocarbon trap is arranged to release trapped hydrocarbons to airflow through the passageway when induction air is drawn through the apparatus during normal engine operation.

13. A motor vehicle comprising an air induction system having a pulsation damper comprising an apparatus as claimed in claim 1.

14. An apparatus as claimed in claim 1, and comprising a former arranged to define the passageway through the apparatus, wherein the pulsation absorber pack and the former are substantially cylindrical in shape, the pulsation absorber pack and the housing being substantially coaxial.

15. An apparatus as claimed in claim 1, wherein the pulsation absorber pack is disposed between the inner surface of the housing and the hydrocarbon trap.

16. A method of trapping hydrocarbon vapor in a motor vehicle air induction system, comprising:

providing a damper configured for damping or attenuating acoustic vibrations in the air induction system, wherein the damper comprises a pulsation absorber pack configured to damp or attenuate acoustic vibrations in the induction air, when an engine of the vehicle is switched off, passing hydrocarbon vapors from the engine of the vehicle through a passageway and trapping the vapors by a flow-past hydrocarbon trap comprising trapping material provided around at least a portion of the passageway, when the engine of the vehicle is switched on, drawing induction air through the passageway and damping or attenuating acoustic vibrations in the induction air by the damper, and providing a housing arranged to define a pulsation damper cavity in which the hydrocarbon trap and damper are provided, wherein the housing has an inner surface, and wherein the pulsation absorber pack is disposed between the inner surface of the housing and the passageway.

17. A method as claimed in claim 16 comprising the step of providing a former within the damper to define a passageway for induction air through the damper and wrapping the hydrocarbon trap around the former.

18. A method as claimed in claim 17 comprising providing the hydrocarbon trap in the form of a sheet.

* * * * *